US007101422B1

(12) United States Patent
Altman et al.

(10) Patent No.: US 7,101,422 B1
(45) Date of Patent: Sep. 5, 2006

(54) POLARITY REVERSING CIRCUIT FOR ELECTROSTATIC PRECIPITATOR SYSTEMS

(75) Inventors: Ralph F. Altman, Chattanooga, TN (US); Robert N. Guenther, Eastampton, NJ (US); Grady B. Nichols, Montevallo, AL (US)

(73) Assignee: Electric Power Research Institute, Palo Alto, CA (US)

( * ) Notice: Subject to any disclaimer, the term of this patent is extended or adjusted under 35 U.S.C. 154(b) by 0 days.

(21) Appl. No.: 11/290,761

(22) Filed: Nov. 30, 2005

Related U.S. Application Data

(62) Division of application No. 10/442,313, filed on Apr. 22, 2003, now Pat. No. 7,001,447.

(51) Int. Cl.
*B03C 3/76* (2006.01)

(52) U.S. Cl. ..... 96/30; 96/31; 96/32; 96/80; 323/903

(58) Field of Classification Search ..... 96/30–38, 96/51, 80–82; 95/74–76; 323/903
See application file for complete search history.

(56) References Cited

U.S. PATENT DOCUMENTS

| | | | | | |
|---|---|---|---|---|---|
| 2,490,979 | A * | 12/1949 | Palmer | 96/31 |
| 2,863,523 | A * | 12/1958 | Klemperer | 96/20 |
| 2,978,065 | A * | 4/1961 | Berg | 96/20 |
| 3,274,753 | A | 9/1966 | Brandt | 96/25 |
| 3,475,882 | A * | 11/1969 | Hoenig | 96/30 |
| 3,487,606 | A * | 1/1970 | Bridges et al. | 95/26 |
| 4,376,637 | A * | 3/1983 | Yang | 95/74 |
| 4,406,672 | A * | 9/1983 | Berz | 95/68 |
| 4,502,002 | A * | 2/1985 | Ando | 96/19 |
| 4,536,698 | A | 8/1985 | Shevalenko et al. | 95/7 |
| 5,015,267 | A * | 5/1991 | Del Gatto et al. | 95/2 |
| 5,114,442 | A * | 5/1992 | Artz | 96/19 |
| 5,173,867 | A | 12/1992 | Johnston et al. | 700/275 |
| 5,378,978 | A | 1/1995 | Gallo et al. | 323/241 |
| 5,792,240 | A | 8/1998 | Lund | 96/32 |
| 5,885,330 | A * | 3/1999 | Lee | 95/69 |
| 5,938,818 | A * | 8/1999 | Miller | 95/63 |
| 6,245,126 | B1 * | 6/2001 | Feldman et al. | 95/59 |
| 6,251,170 | B1 * | 6/2001 | Hironaka et al. | 96/28 |
| 6,336,961 | B1 | 1/2002 | Terai et al. | 96/20 |
| 6,540,812 | B1 * | 4/2003 | Farmer et al. | 95/2 |
| 6,611,440 | B1 * | 8/2003 | Johnston et al. | 363/44 |
| 6,660,061 | B1 * | 12/2003 | Josephson et al. | 95/2 |
| 7,001,447 | B1 * | 2/2006 | Altman et al. | 95/74 |
| 2003/0010203 | A1 * | 1/2003 | Farmer et al. | 95/2 |

FOREIGN PATENT DOCUMENTS

| | | | |
|---|---|---|---|
| WO | WO 89/10198 | * 11/1989 | 96/32 |

* cited by examiner

*Primary Examiner*—Richard L. Chiesa
(74) *Attorney, Agent, or Firm*—Armstrong, Kratz, Quintos, Hanson & Brooks, LLP

(57) ABSTRACT

A gas separation apparatus using electrostatic precipitators and mechanical rappers is enhanced by the addition of an opposite polarity refreshing power supply and a switching arrangement. The switching components selectively disconnect the primary power supply and connect the refreshing power supply to the electrostatic precipitator, causing an electrical impulse in the precipitator sufficient to dislodge precipitate from the collector plates. An RC filter is further provided to control the impulse and reduce the burden that would otherwise be placed upon the refreshing power supply. The novel separation apparatus and technique offer particular synergy when applied to the effluent stream from a coal-fired electric power plant or other similar gas streams.

7 Claims, 2 Drawing Sheets

POLARITY REVERSING CIRCUIT FOR ELECTROSTATIC PRECIPITATOR SYSTEMS

The present application is a divisional application of U.S. Ser. No. 10/442,313 filed on Apr. 22, 2003, now U.S. Pat. No. 7,001,447, and which is incorporated in its entirety herein.

BACKGROUND OF THE INVENTION

1. Field of the Invention

This invention pertains generally to gas separation apparatus using an electric field. More specifically, the present invention uses non-liquid cleaning techniques to maintain electrostatic precipitator electrodes. In a most specific manifestation, a new method and apparatus are provided to dislodge ash from collection plates within an electrostatic precipitator.

2. Description of the Related Art

Industries as diverse as mills, pharmaceutical or chemical, food processing, and cement kilns must separate contaminants or particulates from an air or gaseous stream. The gases may be a product of combustion, such as present in an exhaust stack, but may also represent other gas streams and may contain such diverse materials as liquid particulates, smoke or dust from various sources, and the like. Separators that must process relatively large volumes of gas are common in power generating facilities and factories.

The techniques used for purification of gas streams have been diverse, including such techniques as filtration, washing, flocculation, centrifugation, and electrostatic precipitation. The techniques have heretofore been associated with certain advantages and disadvantages; hence have limited application.

In filtration, particulates are separated through a mechanical filter which selectively traps particles of a minimum size and larger. Unfortunately, flow through a filter is limited by the surface area and cleanliness of the filter. The filter material must be both durable and simultaneously open and porous. In higher volume systems, and in corrosive or extreme environments, filters tend to clog quickly and unpredictably, and present undesirable resistance to the passage of the gas stream. During the period of filter changing or cleaning, which can be particularly tedious, the machine, equipment, or process must be stopped or diverted. This shut-down requires either a duplicate filtration pathway, which may add substantial cost, or a shut-down of the machine or process. Until recently, these limitations present design challenges that have primarily limited this technology to low volume purification.

Washing offers an advantage over dry filtration in presenting the opportunity for selective gas or liquid particulate separation and neutralization, and in reduced gas flow resistance. Unfortunately, the liquid must also be processed; and where there are high levels of particulates, the particulates must be separated from the liquid by yet another process, or the liquid and particulates must be transported to some further industrial or commercial process or disposal location. The added weight and difficulty of handling a liquid (in addition to the particulate) during transport makes liquid separation less desirable in many instances, particularly where there may be a demonstrated application for the particulate content within the gas stream.

Similar to washing, flocculation necessitates the introduction of additional materials that add bulk to the waste stream and unnecessarily complicate the handling and disposal of the contaminants. Furthermore, the flocculating materials must also be provided as raw materials, which may add substantial expense in the operation of such a device, Consequently, flocculation is normally reserved for systems and operations where other techniques have been unsuccessful, or where a particular material is to be removed from the gas stream which is susceptible to specific flocculent that may provide other benefit.

Centrifugation presents opportunity for larger particle removal, such as separation of sand or grit from an air stream. However, centrifugation becomes slower and more complex as the size of the entrained particles or liquids become smaller. Consequently, in applications such as the removal of fly ash from a combustion stream, centrifugation tends to be selective only to relatively large particles, thereby leaving an undesirably large quantity of fine fly-ash in the effluent stream.

Electrostatic precipitators have demonstrated exceptional benefit for contaminants including fly ash, while avoiding the limitations of other processes. For example, unlike centrifugation, electrostatic precipitators tend to be highly effective at removing particulates of very minute size from a gas stream. The process provides little if any flow restriction, and yet substantial quantities of contaminants may be removed from the air stream.

When contaminants pass through an electrostatic precipitator, they pass between discharge electrodes and collection electrodes, which transfer an electrostatic charge to the contaminants. Once charged, the contaminants will be directed by the charge force towards the oppositely charged collecting electrodes. The collecting electrodes are frequently in the form of plates having large surface area and relatively small gap between collector plates. The dimensions of the plates and the inter-electrode spacing is a function of the composition of the gas stream, electrode potential, particulate size of contaminants, anticipated gas breakdown potential, and similar known factors. The selection of dimension and voltage will be made with the goal of gas stream purification in mind, and in gas streams where very fine particulate matter is to be removed, such as with fly ash, relatively high voltage potentials and larger plates may be provided. The proper transfer of charge to the particulates and the subsequent electrostatic attraction to collector plates is vital for proper operation.

By design, the collector plates will accumulate contaminants. As electrically non-conductive particles are deposited, the layers of accumulating particles develop an electrical potential gradient through the thickness of the deposited layer, whereby the voltage at the exposed surface decreases in electrical potential, and possibly even reverses charge. When a sufficiently thick layer of electrically non-conductive particles has accumulated to reduce the surface potential, further significant particulate capture becomes difficult or impossible. Consequently, and in spite of the many benefits, electrostatic precipitators have heretofore been limited in efficiency by the effects of the contaminants on the collection plates.

In order to provide continuous efficient operation of the precipitator, a number of automatically controlled cleaning techniques are used. One almost universal technique used in dry electrostatic precipitators is the use of a mechanical rapper device. The rapper creates vibration in the collector electrodes, in turn causing the precipitate to drop off of the electrodes. Generally the precipitate drops under the influence of gravity or is carried by a special air stream into a separate container for final disposal.

Several patents are exemplary of the use of rappers, including Brandt in U.S. Pat. No. 3,274,753; Johnston et al in U.S. Pat. No. 5,173,867, Lund in U.S. Pat. No. 5,792,240; and Terai et al in U.S. Pat. No. 6,336,961, each of which is incorporated herein by reference for their teachings of rapper systems for use with electrostatic precipitators. Unfortunately, the mechanical rapper systems of the prior art have been known to require substantial cycle times, and the mechanical forces tend to move the contaminant back into the gas stream. Furthermore, rapper systems tend to be maintenance intensive; and, for high resistivity particulate, the rapper tends to be relatively ineffective, owing to the accumulation of electrical charge on the particulate surface.

Since neither the release of undesirable contaminants entrained within the gas stream is desirable, other techniques besides mechanical rappers have been proposed. Gallo et al in U.S. Pat. No. 5,378,978 and Shevalenko et al in U.S. Pat. No. 4,536,698 each illustrates electronic systems to control the accumulation of precipitate upon the electrodes. In particular, the control system of Gallo et al illustrates the challenges of prior art systems, including many components and much complexity. What is desired then is a method or apparatus to overcome these limitations of the present electrostatic precipitators.

SUMMARY OF THE INVENTION

The present invention overcomes the limitations of the prior art by using readily available electronic components in a novel configuration and through a novel operational method.

In a first manifestation, the invention is a method of applying electrical energy to an electrostatic precipitator collector. The method enables operationally effective cleaning using electrical energy, and enhances, supplements or eliminates the operation of mechanical rappers. According to the method, electrical energy having a first electrical polarity is applied to the electrostatic precipitator collector, and the precipitate is collected. A need for cleaning is determined, and applied electrical energy is switched from first electrical polarity to a second, opposite electrical polarity. Rapping may or may not be done while the second electrical polarity is being applied, to remove collected precipitate from the electrostatic precipitator collector. Finally, the applied electrical energy is reset to the first electrical polarity.

In a second manifestation, the invention is a polarity reversing power supply that electrically enhances precipitate removal from an electrostatic precipitator collector. A primary power source has a first electrical power terminal of first polarity connected to the electrostatic precipitator collector and a second electrical power terminal connected to a precipitator electrode. The primary power source, electrostatic precipitator collector and electrostatic precipitator electrode are operatively interconnected to complete a primary electrical circuit through which primary electrical current flows. A first electrical switch is electrically connected within the primary electrical circuit and has a first electrically closed position through which primary electrical current flows and a second electrically open position through which primary electrical current is blocked. A refreshing power source has a first electrical power terminal of second polarity connected to the electrostatic precipitator collector and a second electrical power terminal connected to the precipitator electrode. The refreshing power source, electrostatic precipitator collector and electrostatic precipitator electrode are operatively interconnected to complete a secondary electrical circuit through which secondary electrical current flows. A second electrical switch is electrically connected within the secondary electrical circuit and has a first electrically closed position through which secondary electrical current flows and a second electrically open position through which secondary electrical current is blocked. The first and second electrical switches are operatively coupled to prevent simultaneous closure.

In a third manifestation, the invention is an electrostatic precipitator having at least one discharge electrode for charging particulates within a gas stream, at least one collector for attracting the newly charged particulates, a high voltage power source operatively and selectively able to apply a high voltage potential of a first polarity between discharge electrode and collector, and a rapper for intermittently agitating the collector. A second high voltage power source is operatively and selectively able to apply a high voltage potential of a second polarity opposite to the first polarity between discharge electrode and collector. A switch is included that in a first state operatively completes an electrical circuit to apply high voltage potential from the first high voltage power source between discharge electrode and collector while maintaining said second high voltage power source isolated therefrom, and in a second state operatively completes an electrical circuit to apply high voltage potential from the second high voltage power source between discharge electrode and collector while maintaining the first high voltage power source isolated therefrom. A means is also provided for placing the switch in the second state simultaneous with activating the rapper.

The present invention finds particular utility in a coal-burning power plant, wherein a dry electrostatic precipitation system is employed for removing fly ash, the fly ash being collected on electrostatic plates in the system. In accordance with the teachings of the present invention, a polarity reversing circuit is provided for periodically dislodging the fly ash from the electrostatic plates.

In one embodiment, a mechanical rapping system is provided for dislodging material collected on the electrostatic plates, the polarity reversing circuit supplementing the mechanical rapping system.

Preferably, the intensity of the mechanical rapping system may be varied from zero to a maximum intensity.

OBJECTS OF THE INVENTION

A first object of the invention is to improve the operational effectiveness of electrostatic precipitator systems. A second object of the invention is to reduce the time required to clean collector plates. A third object of the invention is to enhance existing cleaning techniques with a complementary and non-exclusive technique. Another object of the invention is to accomplish the foregoing using readily available electronic components. Yet another object of the invention is to facilitate better collection of fly ash from coal fueled electric utility plants.

These and other objects are achieved in the present invention, which may be best understood by the following detailed description and drawing of the preferred embodiment.

DESCRIPTION OF THE PREFERRED EMBODIMENT

Figure 1:
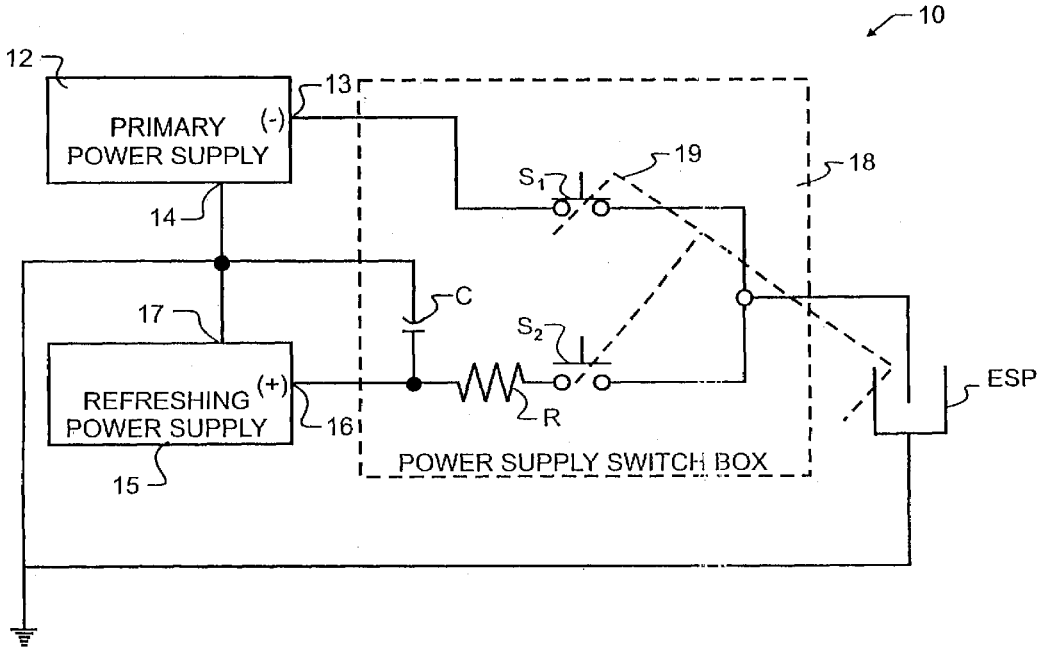
FIG. 1 illustrates a preferred electrical circuit designed in accord with the teachings of the invention by simplified schematic diagram.

With reference to FIG. 1, a preferred polarity reversing circuit 10 includes a primary power supply 12. Power supply 12 may be of any type known in the prior art, and will typically have a first negative voltage output 13 and a second positive polarity output 14 connected to a circuit common or ground connection. In the precipitation of fly ash from an exhaust stream, using an exemplary prior art electrostatic precipitator ESP, power supply 12 will typically provide an output voltage potential of between 5 kilovolts and 150 kilovolts at an operating current typically within the range of 100 to 2500 milliamperes. The negative polarity output 13 is connected to electrostatic precipitator ESP through switch S1, which, during the standard precipitation function, remains closed.

Second refreshing power supply 15 is also preferably provided, and may preferably use the same or similar components as found in primary power supply 12. While this selection of similar components is not necessary for the working of this invention, the use of like or similar components makes testing and maintenance somewhat simpler than working with larger varieties of devices. Refreshing power supply 15, when applied to this exemplary circuit and for use with electrostatic precipitator ESP, will most preferably be able to provide a peak current of approximately 400 milliamperes, at a voltage potential of from 5 kilovolts to approximately 30 kilovolts. Positive output 16 is most preferably connected to electrostatic precipitator ESP through switch S2 and an RC filter comprised by series resistor R and parallel capacitor C, as illustrated in FIG. 1. Preferred polarity reversing circuit 10 will have switch S1 normally closed during standard gas stream precipitation, while switch S2 will remain normally open. When electrostatic precipitator ESP requires cleaning, which may be determined through time interval calculation or through electrical sensing and detection techniques known in the art, switch S1 will be opened and switch S2 will be closed. Electrostatic power supply ESP typically presents a large capacitive load, while most high voltage power supplies of the type used in precipitators present a large inductive output. The combination of inductance and capacitance might lead to an oscillation or ringing, and occasionally a dangerous over-voltage condition or overload for the power supply. The RC filter is provided to prevent an undesirable loading, ringing or similar oscillation or surging of refreshing power supply 15 that might otherwise occur. Resistor R also acts as a current limiter to control surge or in-rush current. Capacitor C may also be used to provide an energy store which will generate a more rapid voltage transition within precipitator ESP than would be attainable otherwise for a given peak current rating for refreshing power supply 15.

Most preferably, refreshing power supply 15 will be connected through switch S2 to electrostatic precipitator ESP for an interval of approximately 1 to 10 milliseconds, which is adequate in many applications to perform operationally effective cleaning. For the purposes of this disclosure, operationally effective cleaning will be understood to be the removal of sufficient precipitate from the collection elements of electrostatic precipitator ESP to maintain satisfactory performance and permit continued operation. The exact timing, and appropriate voltage and current, will be determined by those skilled in the art for a particular electrostatic precipitator and precipitate composition. At the end of the connection interval, switches S1 and S2 will be once again restored to the normal precipitation arrangement, where S1 will be closed and S2 will be open.

Switches S1 and S2 will most preferably not be simultaneously closed. Such closure would result in resistor R serving as the entire load for both power supplies 12, 15. This is a waste of substantial electrical energy and will create a potentially very dangerous overload. Control of switches S1, S2 to maintain at least one switch open at all times is known in the switching art, and may be achieved through an open-before-close arrangement where activation is mechanical, or through specific electrical or electronic control circuitry, or the switches may be mechanically coupled to prevent simultaneous closure. The means to control switching of switches S1, S2 and activation of the rapper within electrostatic precipitator ESP is illustrated by dashed line 19 in FIG. 1, which is the ordinary symbol for mechanical coupling of electrical devices, but, as aforementioned, such coupling may be through electronic control as well.

The preferred physical arrangement illustrated in FIG. 1 is to incorporate the RC filter and switches S1, S2 into a separate power supply switch box 18. The exact nature of this box 18 will depend upon the type of switches chosen for switches S1, S2, which are known in the art to include mechanical, electromechanical, solid state or vacuum tube switches. Power supplies 12, 15 are each separately housed, which simplifies maintenance by permitting easy modular replacement of malfunctioning devices.

Figure 2:
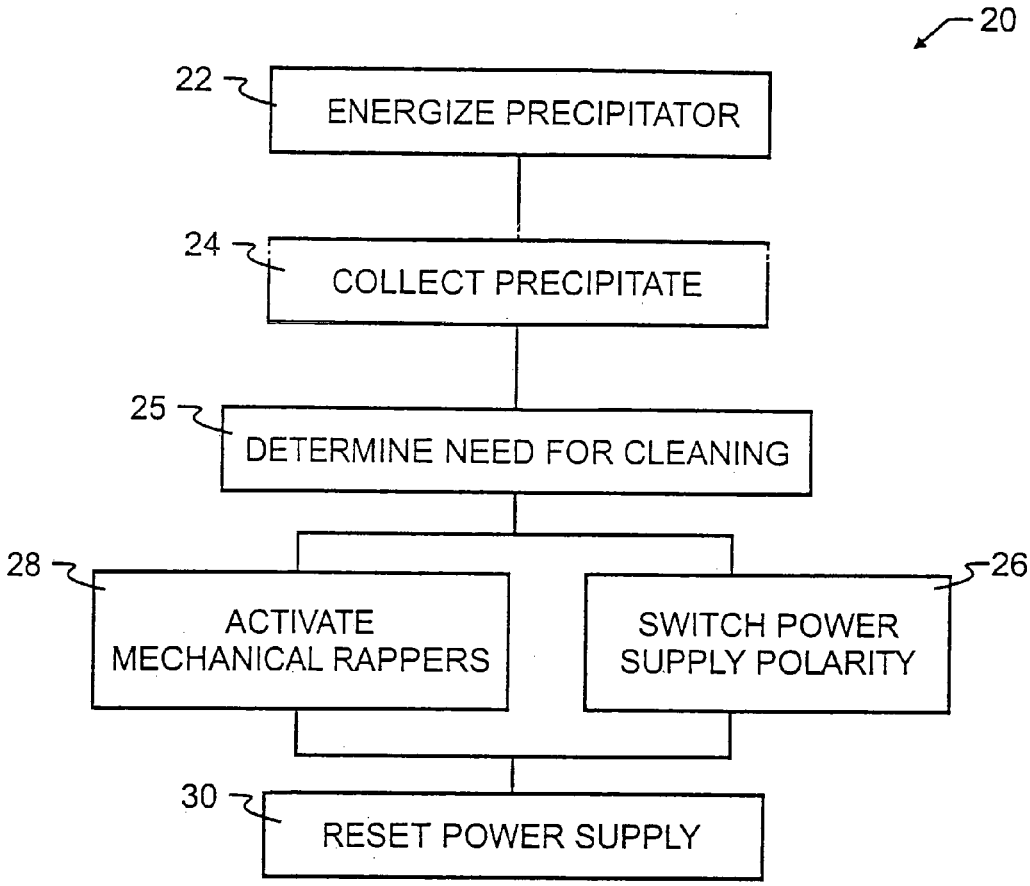
FIG. 2 illustrates a preferred method designed in accord with the teachings of the invention.

With reference to FIG. 2, the preferred method 20 of cleaning ash from an electrostatic precipitator, which will be described herein for exemplary purposes utilizing the preferred embodiment polarity reversing circuit 10 for implementation, includes at step 22 the energizing of precipitator ESP. This is accomplished in polarity reversing circuit 10 by energizing primary power supply 12 and closing switch S1. At step 24, precipitate will be collected, generally by passing the gas stream with entrained particulate through electrostatic precipitator ESP. During this step 24, switch S1 will remain closed and switch S2 will remain open. Precipitate will normally be collected until such a time as there is a determined need for cleaning the collector plates. This determination of need for cleaning 25 may be time-based or by other known technique, the exact method which is not critical to the operation of the present invention. The method of determining will normally be selected to optimize power while holding particulate re-entrainment at a low level.

When the need for cleaning is determined in step 25, power supply polarity will be switched at step 26. This will preferably generate an impulse of opposite polarity. As may be recognized in association with the present description, a rapid impulse offers substantial benefit where high resistivity particulate is being collected. This is due to the reverse polarity phenomenon described herein above, where high resistivity particulate will gradually form an insulation layer and static charge of opposite polarity is retained or collected in the particulate. Consequently, a rapid impulse of reversed polarity will generate very consequential electrostatic force which repels the particulate from the collector plates. The time required for a reverse polarity impulse to clear the collector will be determined by the physical, chemical and electrical characteristics of the particulate as well as the plate geometry, impulse voltage and waveform, and other factors too numerous to describe in detail herein, but may be readily determined and optimized experimentally by those skilled in the art for a given application. For the application to fly ash precipitate, a time of from 1 to 10 milliseconds has been determined to be optimal.

The electrical cleaning of precipitate is very rapid, and provides a reliable approach to the maintenance of an electrostatic precipitator. The benefit over prior art mechanical rappers, which must be tested manually or visually to determine whether they are operating properly, is very significant. For some dry high resistivity precipitates, the reverse polarity impulse may be all that is required to clean the collector plates. However, the present invention further contemplates the use of the reverse polarity impulse in conjunction with mechanical rappers, as shown by parallel step 28. Most preferably, the reverse impulse of step 26 will be timed to correspond to the mechanical impulse of step 28, thereby forming a synergistic benefit which ensures complete removal of precipitate.

Once the precipitate is removed from the collector plates in step 26 and optional step 28, primary power supply 12 will be reset to provide power to electrostatic precipitator ESP, and refreshing power supply 15 will be disconnected therefrom. This is identified in FIG. 2 as step 30, where the power supply is reset to normal collecting condition. Method 20 of cleaning ash may then return to step 24, where precipitate is once again collected. As will be apparent, FIG. 2 does not include various optional steps that may be further included, depending upon the design of the physical apparatus, such as the use of ash collection techniques (hoppers, bags, etc.) as known in the prior art.

Having thus disclosed the preferred embodiment and some alternatives to the preferred embodiment, additional possibilities and applications will become apparent to those skilled in the art without undue effort or experimentation. Therefore, while the foregoing details what is felt to be the preferred embodiment of the invention, no material limitations to the scope of the claimed invention are intended. Further, features and design alternatives that would be obvious to one of ordinary skill in the art are considered to be incorporated herein. Consequently, rather than being limited strictly to the features recited with regard to the preferred embodiment, the scope of the invention is set forth and particularly described in the claims herein below.

What is claimed is:

1. An electrostatic precipitator having at least one discharge electrode for charging particulates within a gas stream, at least one collector for attracting said charged particulates within said gas stream, a high voltage power source operatively and selectively able to apply a high voltage potential of a first polarity between said at least one discharge electrode and said at least one collector, and a rapper for intermittently agitating said at least one collector, wherein the improvement comprises:

a second high voltage power source operatively and selectively able to apply a high voltage potential of a second polarity opposite to said first polarity between said at least one discharge electrode and said at least one collector, and a switch that in a first state operatively completes an electrical circuit to apply said high voltage potential from said first high voltage power source between said at least one discharge electrode and said at least one collector while maintaining said second high voltage power source isolated therefrom, and in a second state operatively completes an electrical circuit to apply said high voltage potential from said second high voltage power source between said at least one discharge electrode and said at least one collector while maintaining said first high voltage power source isolated therefrom, and a means for placing said switch in said second state simultaneous with activating said rapper.

2. The electrostatic precipitator of claim 1, wherein said first high voltage power source and said second high voltage power source are discrete modules that are individually replaced during repair.

3. The electrostatic precipitator of claim 1, further comprising a charge accumulator storing said high voltage potential of said second polarity.

4. The electrostatic precipitator of claim 1, further comprising a current limiter in series with said second high voltage power source and said at least one collector.

5. The electrostatic precipitator of claim 1, wherein said particulates comprise fly ash.

6. The electrostatic precipitator of claim 5, wherein said switch placing means maintains said switch in said second state for one to ten milliseconds.

7. The electrostatic precipitator of claim 6, wherein said high voltage potential of said high voltage power source is between 5,000 and 150,000 volts, and said high voltage potential of said second high voltage power source is between 5,000 and 30,000 volts.

* * * * *